US006390003B2

(12) United States Patent
Rumi

(10) Patent No.: US 6,390,003 B2
(45) Date of Patent: May 21, 2002

(54) FEEDING A SOCK TIP TO A SEWING MACHINE

(76) Inventor: Guerrino Rumi, Via Panoramica, 35a, I-25082 Botticino Sera (IT), I-25082

( * ) Notice: Subject to any disclaimer, the term of this patent is extended or adjusted under 35 U.S.C. 154(b) by 0 days.

(21) Appl. No.: 09/773,436

(22) Filed: Feb. 1, 2001

(30) Foreign Application Priority Data

Feb. 4, 2000 (IT) ..... MI20A0178

(51) Int. Cl.[7] ..... D05B 35/00; D05B 39/00

(52) U.S. Cl. ..... 112/475.07; 112/475.12; 112/475.15

(58) Field of Search ..... 112/475.07, 475.12, 112/470.29, 63, 470.15

(56) References Cited

U.S. PATENT DOCUMENTS 3,090,963 A * 5/1963 Wittman ..... 112/475.12
4,516,513 A * 5/1985 Gazzarrini ..... 112/475.12
5,207,165 A * 5/1993 Gazzarrini ..... 112/472.12
5,460,108 A * 10/1995 Migliorini ..... 112/470.15
6,158,367 A * 12/2000 Jordan et al. ..... 112/475.07

* cited by examiner

*Primary Examiner*—Ismael Izaguirre
(74) *Attorney, Agent, or Firm*—Herbert Dubno; Andrew Wilford

(57) ABSTRACT

The equipment for automatically feeding a sewing machine with a sock tip comprises a device for gripping the sock from the area of formation of the same on a circular machine for socks and at least one device for transferring the gripping device to a predetermined final position for feeding the sewing machine, which comprises rotation means of the gripping device adapted to impart a rotation speed to it that is synchronised with the rotation speed of the needle cylinder of the circular machine when the gripping device is in a predetermined position inside the needle cylinder so as to form an annular gap with the latter, inside which the sock arranges during its formation.

20 Claims, 8 Drawing Sheets

FEEDING A SOCK TIP TO A SEWING MACHINE

FIELD OF THE INVENTION

The present invention relates to an apparatus and a method for automatically feeding a sewing machine with a sock tip.

BACKGROUND OF THE INVENTION

As known, socks manufactured on circular machines for socks are currently defined by a tube having a heel and a tip which, once the tube has been completed, remains open. Thus, after manufacturing the sock, the latter is manually taken and, after orienting the two sides of its aperture in a predetermined way, it is inserted into a suitable sewing machine which sews the tip closed, thus connecting the two edges of its aperture.

In some types of circular machines for socks, the sock tip has recently been directly sewn in the machine for manufacturing it. However, beside being extremely complex and expensive, and beside significantly complicating the entire structure of the machine, such a solution has the disadvantage of frequently jamming the machine, which interrupts not only the sock tip sewing, but also the production of the sock.

In fact, in a particular type of circular knitting machine for manufacturing socks, each sock is arranged so that its tip is sewn, and it is withdrawn by means of the cylinder needles to the needles of the withdrawing device, with all the consequences that such operation implies.

In another type of machine the tips are even sewn together in the same machine that manufactures the socks, thus further complicating same and further increasing the possibility of jamming the machine. Moreover, sewing of a sock tip together in the machine that manufactures it implies that a separate device adapted to sew the sock tip must be arranged on each machine. Thus this device can be only applied to that type of machine and not to other types of machines.

For these reasons, and for the considerable purchase costs of the machines used for such purpose, sock sewing is still substantially carried out by manually withdrawing the sock from the machine and then orienting it in a suitable way on the sewing machine, with a consequent use of manpower which makes the production and sales costs of the finished sock increase.

OBJECTS OF THE INVENTION

The object of the present invention is to eliminate the disadvantages of the prior art mentioned above.

Within the scope of this object, and important object of the present invention is providing an apparatus and a method for automatically feeding a sewing machine with a sock tip which should allow this operation to be done outside the machine that manufactures the sock so as to be an autonomous and independent operation with respect to the actual manufacture of the sock tube.

Another object of the invention is providing an apparatus and a method for automatically feeding a sewing machine with a sock tip which could be applied to any machine for manufacturing socks without having to substantially modify its structure.

Another object of the invention is providing an apparatus and a method for automatically feeding a sewing machine with a sock tip which allows concurrently feeding a sewing machine from one or more machines that manufacture the socks.

A further object of the invention is providing an apparatus and a method for automatically feeding a sewing machine with a sock tip wherein the apparatus is not part of the circular sock machine, thus preventing a considerable complication of same and preventing the possibility of jamming it.

A further object of the invention is providing an apparatus and a method for automatically feeding a sewing machine with a sock tip wherein the sock withdrawal from the needle cylinder occurs without having to deliver the stitches by the cylinder needles to the withdrawing device so as to eliminate any difficulty which the operation implies.

Last but not least, another object of the invention is that of providing an apparatus and a method for automatically feeding a sewing machine with a sock tip which allows reducing or totally eliminating the use of manpower with consequent relevant having on the production and sales cost of the finished product.

SUMMARY OF THE INVENTION

These objects are achieved by an apparatus for automatically feeding a sock tip to a sewing machine, the apparatus comprising a device for gripping the sock from the area of formation of same on a circular machine for socks and at least one device for transferring the gripping device in a final predetermined position for feeding the sewing machine. According to the invention rotation means for the gripping device imparts a rotation speed to it that is synchronized with the rotation speed of the needle cylinder of the circular machine when the gripping device is in a predetermined position inside the needle cylinder so as to form an annular gap with the latter, inside which the sock hangs during its formation.

Another object of the present invention is a method for automatically feeding a sewing machine with a sock tip which is characterized in that it consists in moving a gripping device of the sock into the needle cylinder of a circular machine for socks by concurrently applying air suction inside it, in bringing the gripping device into rotation in synchrony with the needle cylinder, in manufacturing the tube of the sock without a knit course, in pinching the knit of the tube by the gripping device on at least two diametrically opposed portions, in completing the knit course of the tube in the needle cylinder so that, once completed, the sock is oriented according to a predetermined orientation according to the final requirements, and in withdrawing the sock thus oriented from the needle cylinder to move it to the sewing machine.

Again, the sock obtained through the method described above and with the equipment described above is characterized in that, near the sewing portion of the aperture of the sock, it comprises a thickening adapted to define a mechanical abutment for aligning the sewing portion with the guides of the sewing machine.

BRIEF DESCRIPTION OF THE DRAWING

Further features and advantages of the invention will appear more clearly from the description of a preferred but not exclusive embodiment of an apparatus and a method for automatically feeding a sewing machine with a sock tip according to the invention, illustrated by way of a non-limiting example in the attached drawings. In these drawings.

SPECIFIC DESCRIPTION

Figure 2:
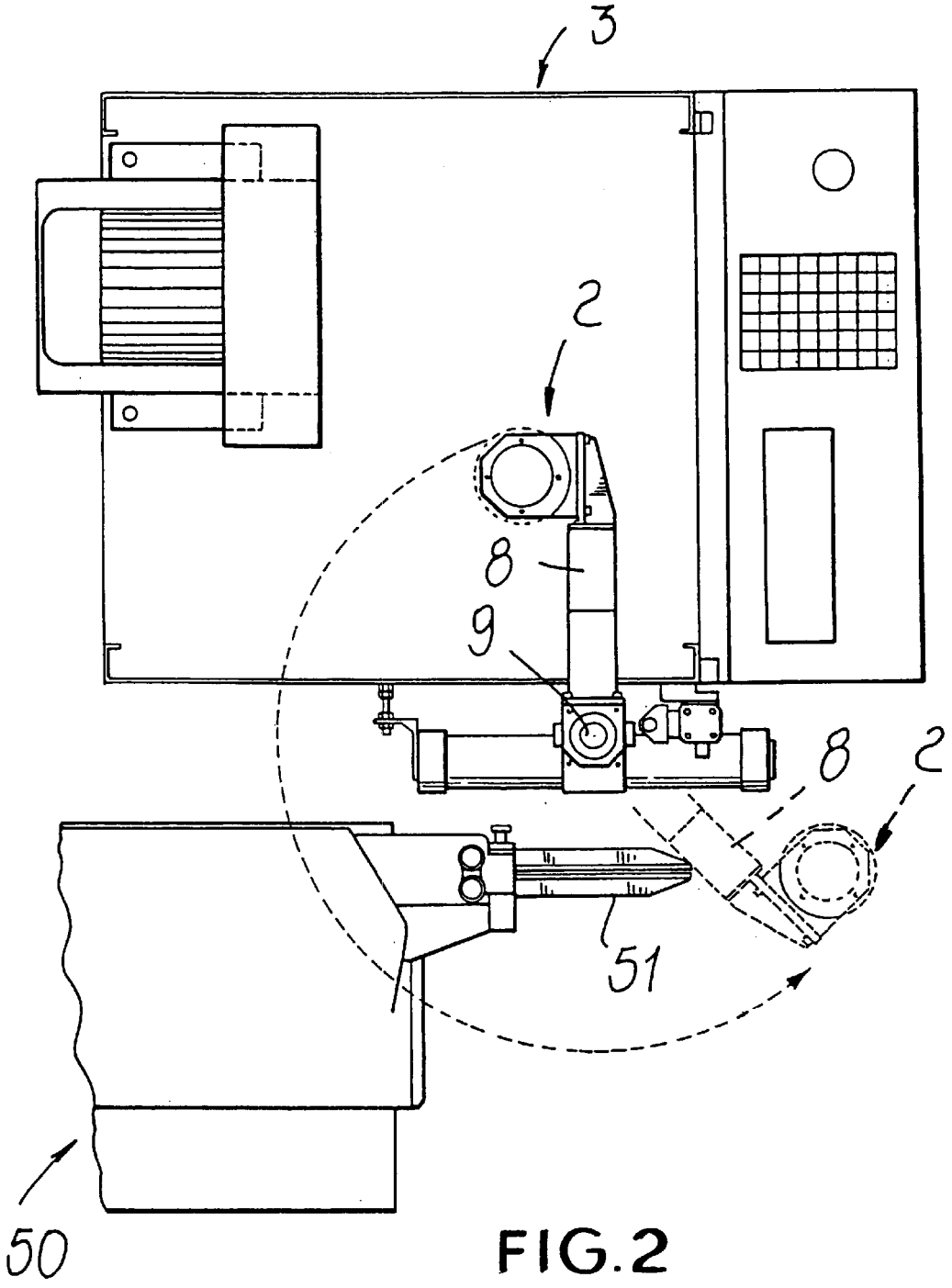
FIG. 2 shows a plan view of the apparatus shown in FIG. 1 according to the invention.
Figure 3:
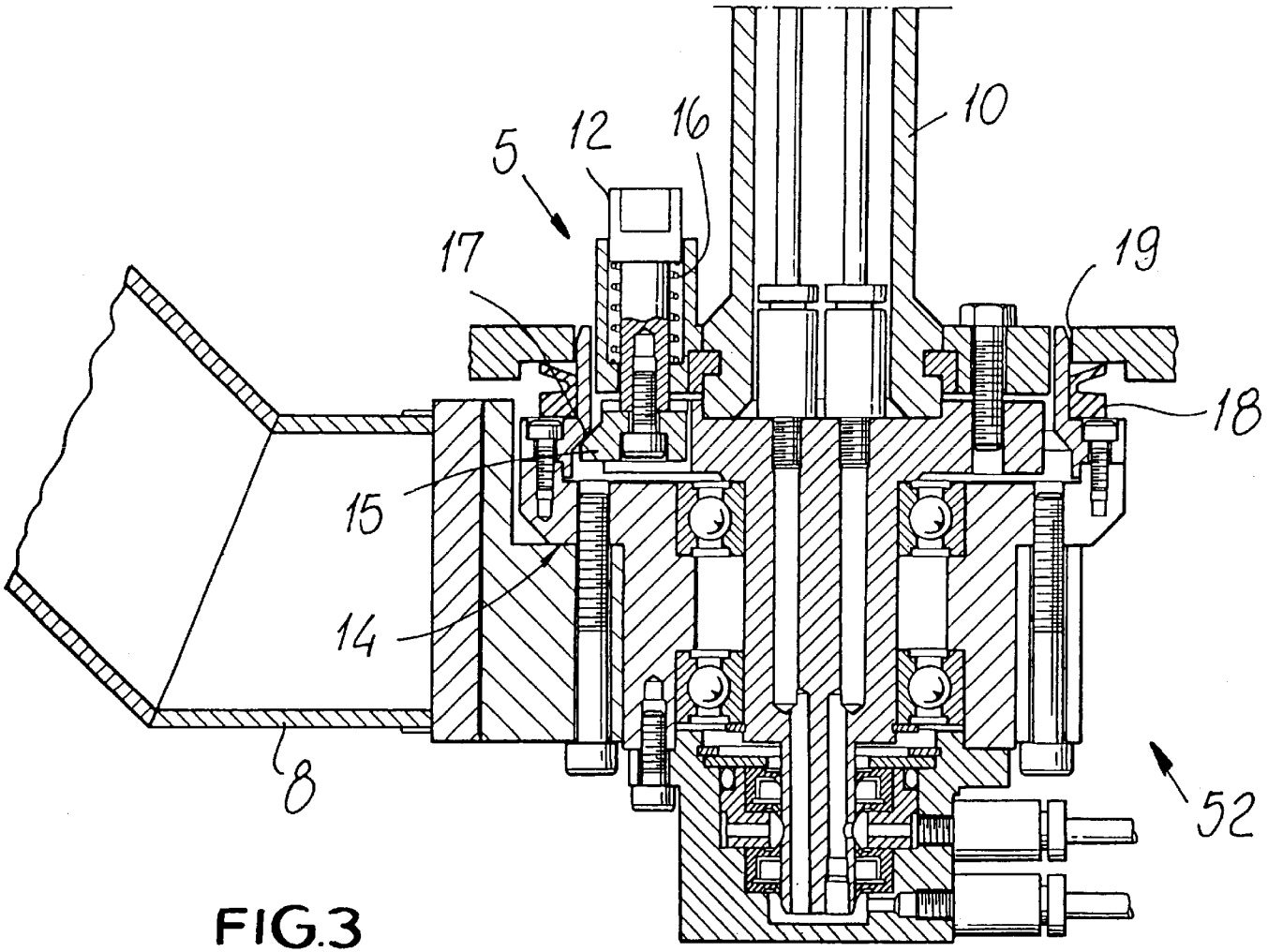
FIG. 3 shows an enlarged sectioned view of the base of the sock-gripping device according to the invention.

With reference to the above-described drawing, the apparatus for automatically feeding a sewing machine with a sock tip according to the invention comprises a device 2 for gripping the sock and adapted to engage the sock from the formation area of same on a circular knitting machine 3 for socks. Moreover, the apparatus comprises at least one device 4 for transferring the sock-gripping device 2 to a final predetermined position for feeding a sewing machine 50 (FIG. 2).

Advantageously, the apparatus comprises rotation means 5 (FIG. 12) for the gripping device 2, which are adapted to impart a rotation speed to the latter that is synchronized with the rotation speed of a needle cylinder 6 of the circular machine 3 when the sock-gripping device 2 is in a predetermined position inside the needle cylinder 6.

Figure 1:
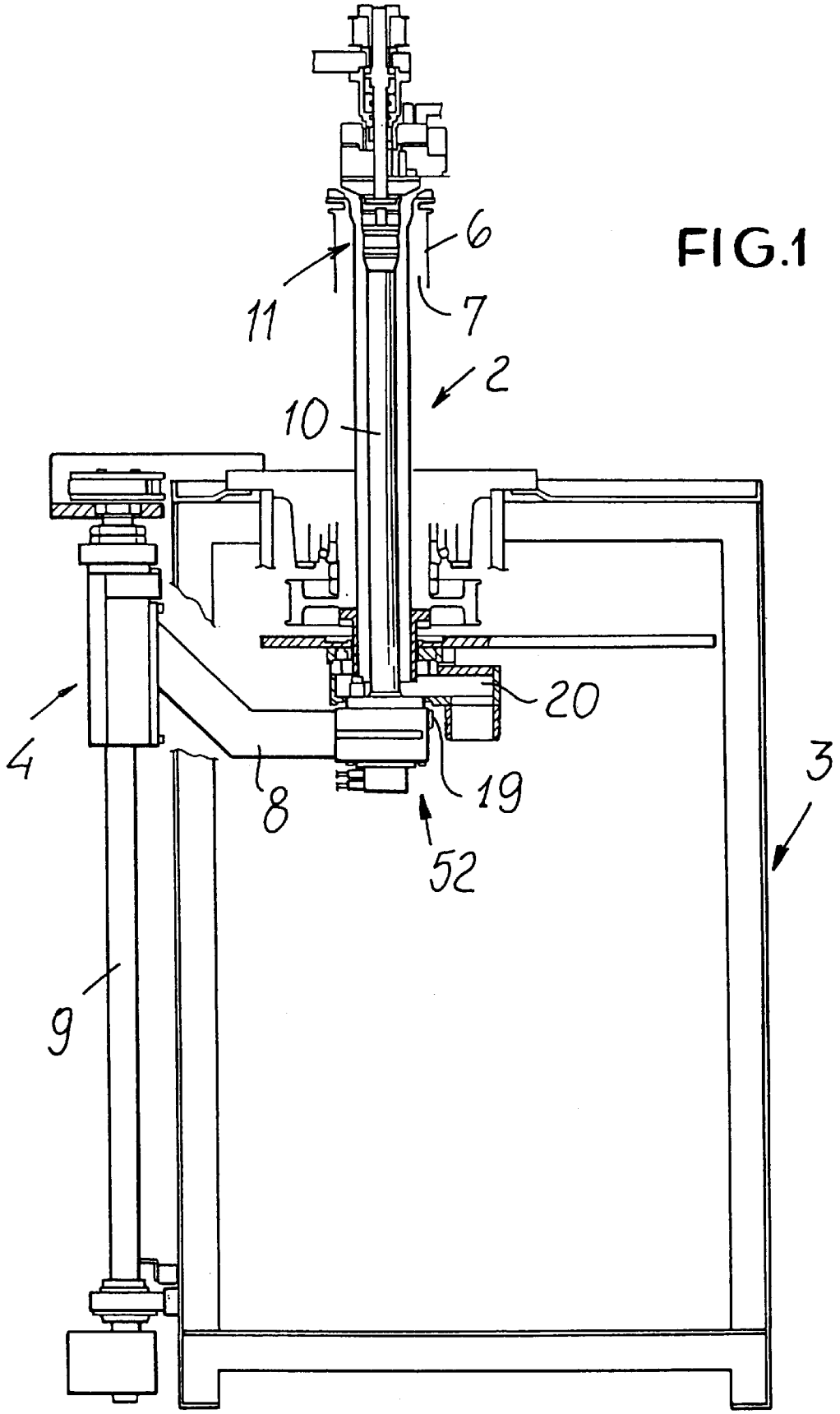
FIG. 1 shows a schematic side elevation view of a circular machine for socks with the apparatus for automatically feeding a sewing machine with a sock tip.

In this way, an annular gap 7 forms between the gripping device 2 and the needle cylinder 6, inside which the sock hangs during its formation, also with the help of air suction in the needle cylinder 6. In particular, the transfer device 4 comprises an arm 8 supporting the sock-gripping device 2. Arm 8 is mobile along a guide 9 that is parallel to the needle cylinder 6 so as to move the sock-gripping device 2 from a first position outside the needle cylinder 6 to a second position inside same, as shown in FIG. 1, and vice versa. Moreover, the transfer device 4 is adapted to move the gripping device 2 from the first position coaxial to the needle cylinder 6 to at least one final predetermined position adapted to allow the insertion of the sock into guides 51 of the sewing machine 50 in an optimum way.

More in detail, the sock-gripping device 2 comprises a 5 support base 52 associated with the arm 8 and which rotatably supports an elongated tube member 10 having, at its end, means 11 (FIG. 4) for withdrawing the sock from the needle cylinder 6. The base 52 of the gripping device 2 comprises the above-mentioned rotation means 5 having connection means 12 defined by a quadrangular-head mechanical coupling for operatively connecting the elongated tube member 10 with the needle cylinder 6 so as to synchronize the rotation speed of the tube member with that of the needle cylinder. The base 52 of the gripping device 2 comprises holding means 14 adapted to block the elongated tube member 10 in a predetermined angular position when the connection means 12 is not actuated, that is, is not engaged with the needle cylinder 6. The holding means 14 comprises a braking element 15 defined by an inclined surface 17 adapted to engage with an inclined counter-surface integral with arm 8. The braking element 15 is actuated by the movement of the connection means 12 under the action of elastic means, in particular, of a spring 16.

In this way, when the connection means 12 is pressed against the needle cylinder 6, the braking element 15 lowers, thus allowing synchronized rotation of the tube member 10, whereas when the connection means disengages from the needle cylinder 6, a spring 16 brings the braking element 15 back against the inclined surface 17, thus blocking the tube member 10 in the predetermined position required also during movement of same outside machine 3 by arm 8.

Moreover, the base 52 comprises a sealing member defined by an annular gasket 18 and adapted to sealingly close an aperture 19 of a channel through which air is sucked from the needle cylinder 6 when the elongated member 10, and thus the withdrawing means 11, are in the second position, that is, in the needle cylinder.

Figure 4:
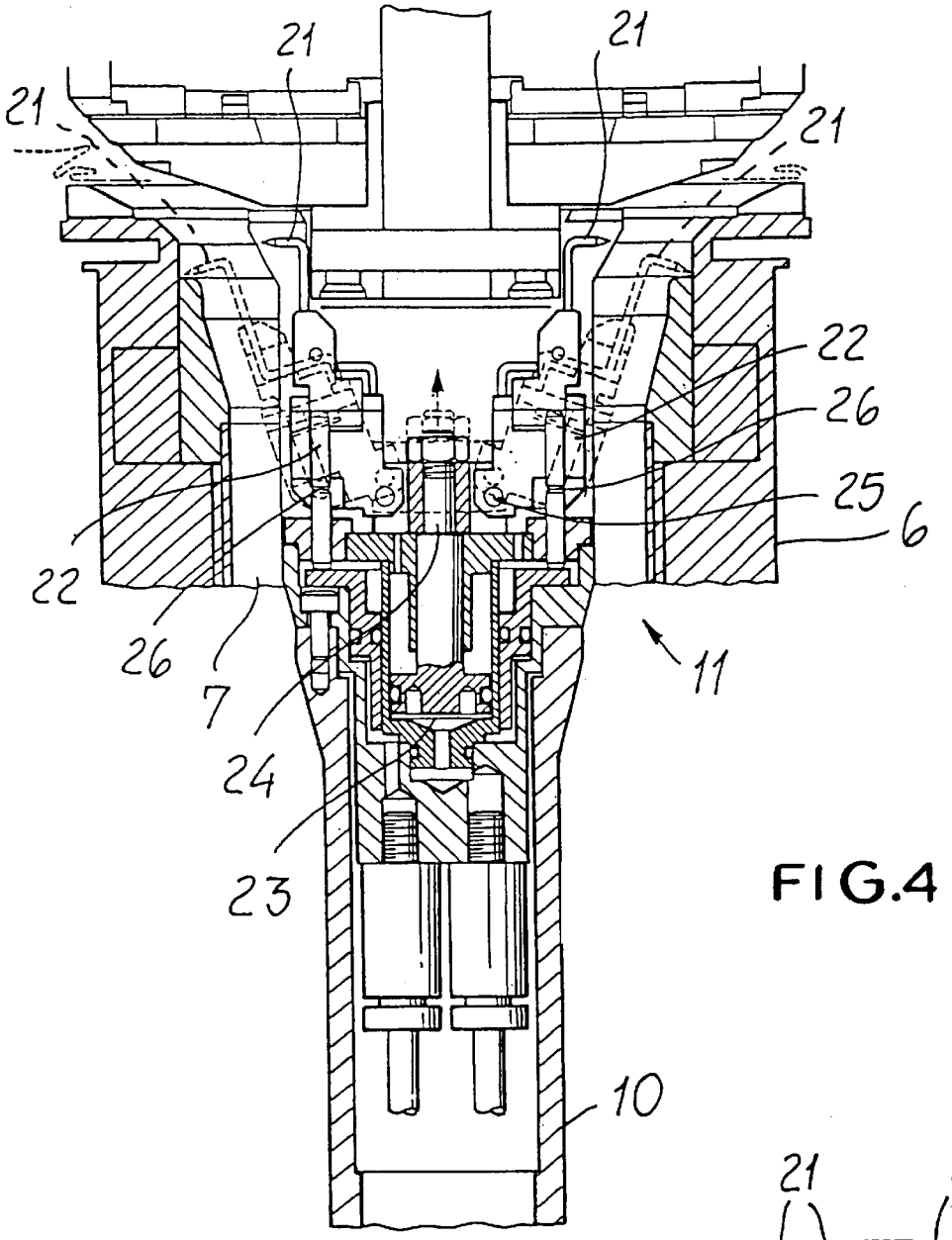
FIG. 4 shows a schematic view showing the withdrawing means of the sock-gripping device according to the invention.
Figure 5:
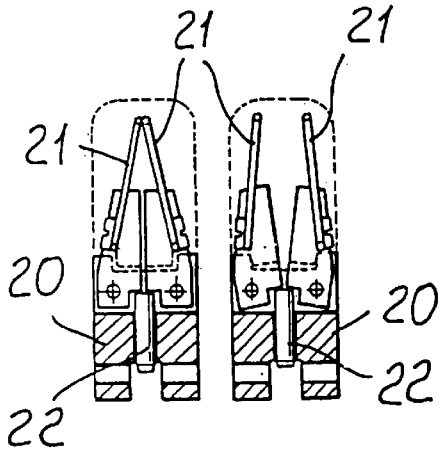
FIG. 5 schematically shows the linkage adapted to make the pointed sock gripping members diverge and converge according to the invention.

The withdrawing means 11 comprises as shown in FIGS. 4 and 5 a linkage adapted to move at least two support bodies, and in particular in a preferred solution, at least four support bodies 20 each supporting at least two pointed members 21 which are adapted to penetrate, as better explained hereinafter, into at least four angularly equispaced areas of the knit of the sock tube. In particular, the linkage adapted to move the four support bodies 20 comprises a first driving member 22 adapted to make the pointed members 21 diverge and converge, as shown in FIG. 5, in contrast with and under the action of first elastic means defined by the body itself of the pointed members 21. Moreover, the linkage also comprises at least a second driving member 23 adapted to transform rectilinear motion of a shaft 24 into rotation of the four support bodies 20.

The support bodies 20 are pivoted on the shaft 24 along pivot axes 25, and are connected the first driving member 22 by pin 26 and thus they are forced to oscillate from a position that is inside the elongated member 10, to a position that is outside same, so as to penetrate via the pointed members 21 the knit of the tube and afterward, when the pointed members 21 have pinched the fabric as shown on the left in FIG. 5, and retract them so as to remove the sock from the needle cylinder 6.

Figure 9:
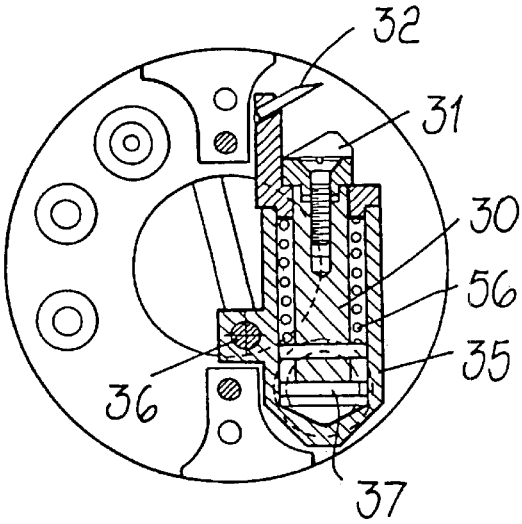
FIGS. 9 and 10 show a plan view of the withdrawing means shown in FIG. 8, showing the rotation of the support bodies of the pointed members according to the invention.
Figure 11:
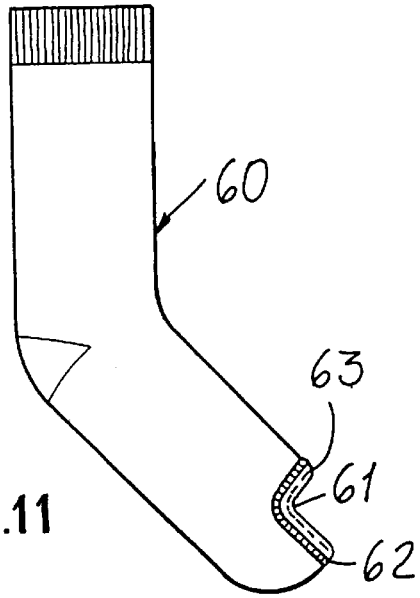
FIG. 11 shows a schematic view of the sock that is manipulated by the apparatus object of the invention for allowing the automatic sewing of its tip.
Figure 10:
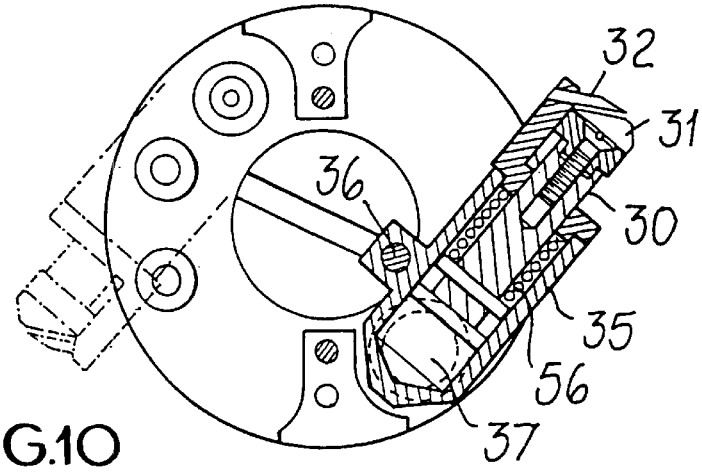
Figure 8:
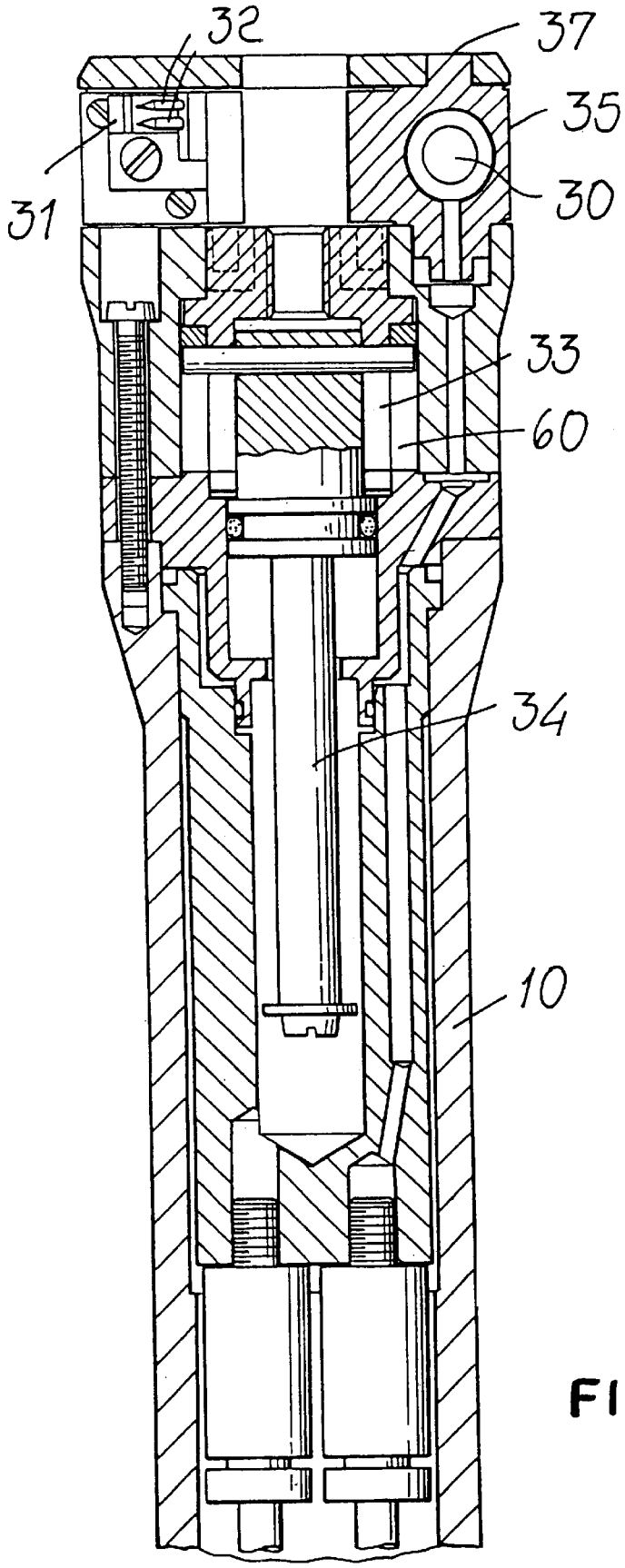
FIG. 8 shows a sectioned side elevation view of a second embodiment of the means for withdrawing the sock from the needle cylinder according to the invention.

In a constructive variant shown in FIGS. 8, 9, and 10, the linkage comprises a first driving member defined by a small piston 30 adapted to move a pinching head 31 against pointed members 32 for gripping the sock. The small piston 30 is mobile against the force of elastic means defined by a spring 56. The linkage also comprises a second driving member 33 adapted to transform the rectilinear motion of a shaft 34 into rotation of the two support bodies 35 of the pointed members 32 with the help of helical cams 60. In particular, the support bodies 35 of the pointed members 32 and of the small piston 30 and of the pinching head 31, are pivoted at pivots 36 on the second driving member 33 and through pivots 37 with the tubular member 10.

Figure 6:
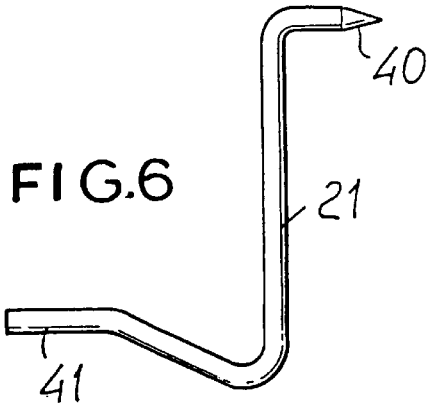
FIG. 6 shows a side elevation view of a pointed member adapted to withdraw the sock according to the invention.
Figure 7:
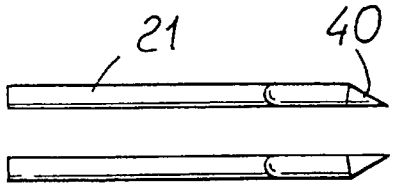
FIG. 7 shows a partial plan view of the pointed members adapted to withdraw the sock according to the invention.

Advantageously, the pointed members in the first solution shown in FIGS. 6 and 7 are made of music wire, and each of them has a first end portion having a tip 40, which is inclined towards the other, and a second rectilinear end portion 41 which is integrally connected with the support bodies and which, during the convergence and the separation of the pointed members, determines an elastic flexo-torsion of the same which, after stress, return to their initial position.

Figure 12:
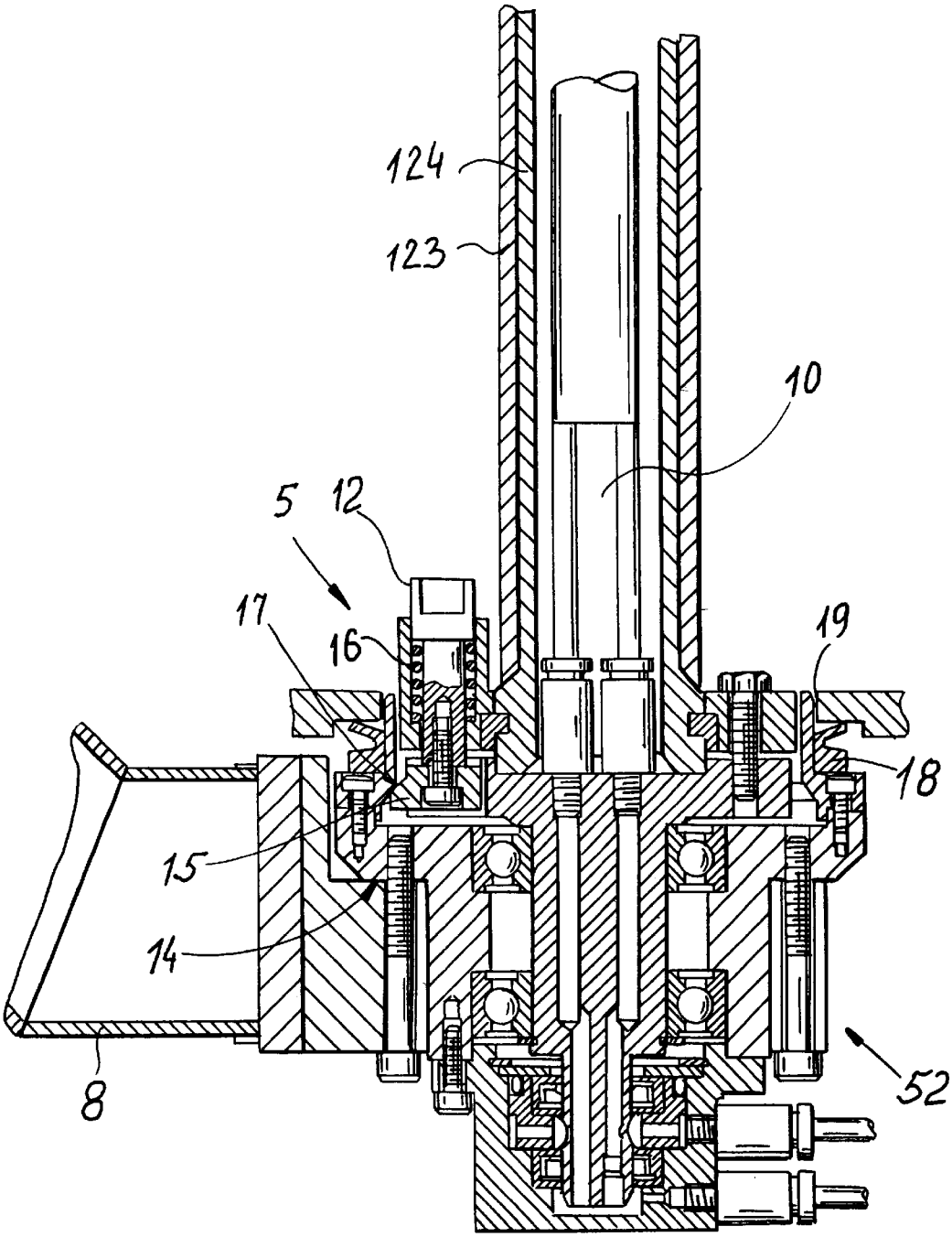
FIGS. 12 and 13 show a different embodiment of the withdrawing means of the sock-gripping device according to the invention.
Figure 13:
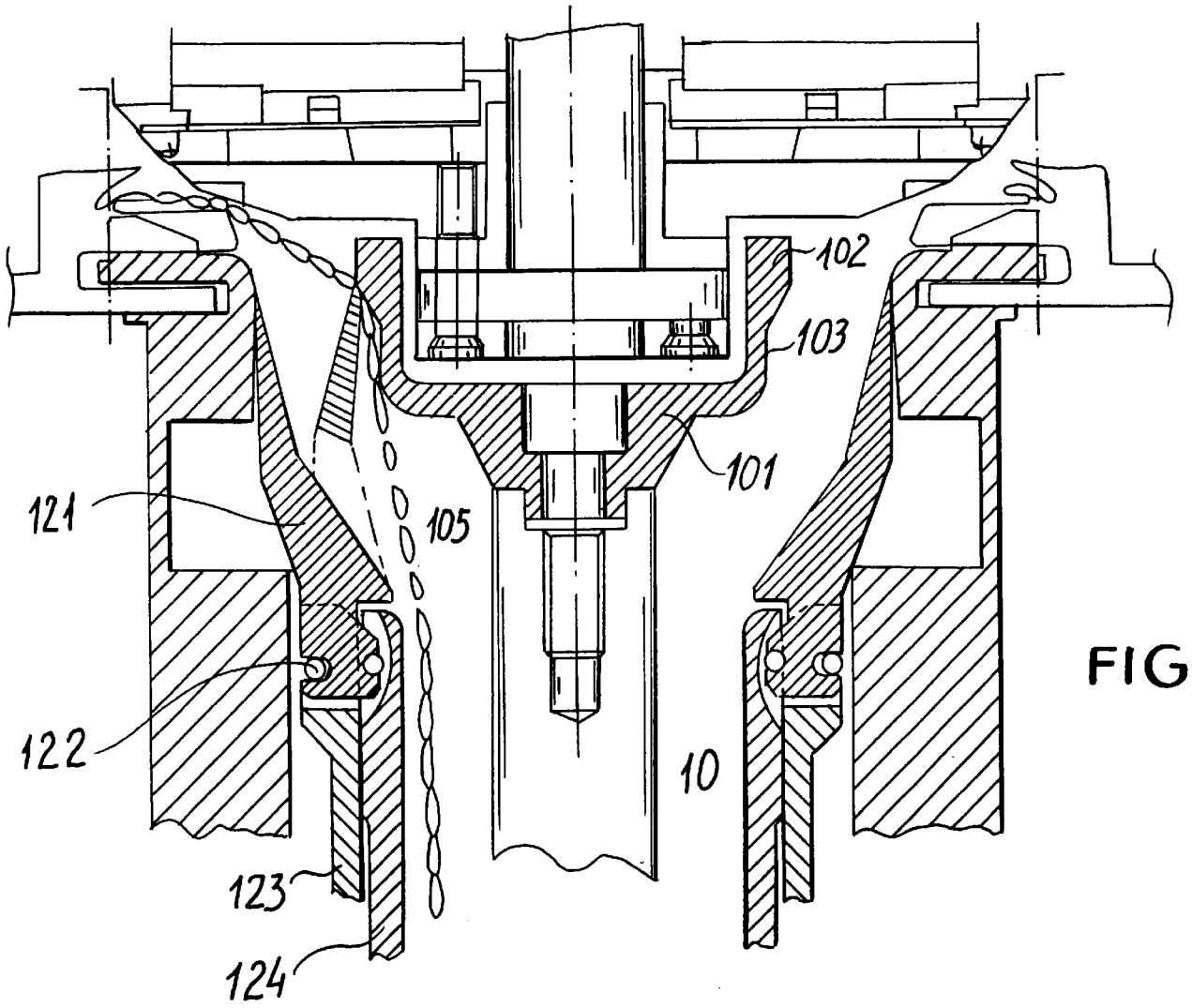

In a different example shown in FIGS. 12 and 13, the withdrawing means comprises a linkage adapted to move at least two (or four) pointed members 121. The pointed members 121 are pivoted at 122 on a fixed tube support 123 inside which there is a sliding mobile tube element 124 whose ends are pivoted on the pointed members 121.

In this embodiment, the elongated member 10 (having a reduced diameter with respect to the previous solution) has an end 101 provided with a thickened edge 102 against which the pointed members 121 are adapted to move, and a recessed portion 103 for the passage of the sock 105. The sock 105 hangs down between the tube member 124 and the elongated member 10. The elongated member 10 and the tube members 123, 124 are pulled out from below while on the other hand, when the sock must be withdrawn from the sewing machine, it is pulled out from above after spreading of the pointed members 121. In this solution, the sock 105 does not slide against the external containment tube (not shown, coaxial to the tube members 123 and 124).

The pointed members 121 pushed by the tubular member 124 rotate around pivots 122, passing from a spaced position with respect to the end 101 of the elongated member 10 to a position that is close to the elongated member 10 (with the interposition of the sock). In practice, the pointed members 121 close, thus pressing the sock against end 101 and clamping it there.

Another object of the present patent application is also a method for automatically feeding a sewing machine with a sock tip. In particular, the method consists in moving a device for gripping the sock into the needle cylinder of the circular machine for socks. During engagement of the gripping device into the needle cylinder, air suction is concurrently applied to same and the needle cylinder is connected to the gripping device so as to bring the latter into rotation at the same speed as the needle cylinder.

Once this operation has been done, the tube of the sock is manufactured in the standard manner without a knit course, that is, by making the needle cylinder perform one turn less. At this point, the gripping device pinches the knit of the sock tube on at least two diametrically opposed portions.

For example, if the withdrawing means shown in FIG. 4 is used, the tube is pinched on four portions that are angularly equispaced, whereas in the case of the withdrawing means shown in FIG. 8, the tube is only pinched on two diametrically opposite portions.

Once the sock tube has been pinched, the last knit course is performed, that is to say, the needle cylinder is made to make one more turn so that, once completed, the sock heel and its mouth are oriented according to a predetermined orientation in function of the final requirements of orientation of the sock, which will allow it to be inserted into the sewing machine. The sock thus oriented is then withdrawn from the gripping device and transported externally to the needle cylinder.

During withdrawal of the sock from the needle cylinder, the gripping device is automatically locked so as to prevent a possible accidental movement of same, and thus of the sock, from the predetermined position. Moreover, suction into the needle cylinder is interrupted.

After extraction of the sock from the needle cylinder by the gripping device, the latter is moved outside the circular machine by a fixed distance through a rotation movement around a parallel axis with respect to that of the needle cylinder.

Once the position has been reached, according to which the sock orientation into the needle cylinder has been previously determined, the gripping device is lifted again in order to move the sock into the correct predetermined position, so as to be transferred into the sewing machine.

Since the gripping device is provided with withdrawing means that comprises a linkage adapted to move, in a first solution, four support bodies, each supporting two pointed members adapted to penetrate into at least four diametrically opposed portions of the sock tube, the pointed members will be in a retracted position during withdrawal of the sock from the needle cylinder, and in an open position, outside the machine, for opening the sock aperture in an optimum way to be gripped and brought into the sewing machine.

On the other hand, if the pointed members only act on two diametrically opposed points of the sock tube by means of the two pointed members, opening of the aperture of the latter also is aided by blowing in air, which helps to carry out this operation.

Advantageously as shown in FIG. 10, near the sewing portion of aperture 61, the sock 60, which is manufactured on the circular machine for socks, has an annular thickening 62 adapted to define a mechanical abutment capable of allowing the alignment of the sewing portion into the guides of the sewing machine.

Moreover, for the purpose of facilitating the automatic opening of its aperture, so as to facilitate the gripping of the sock after it has been oriented and transferred outside the circular machine, the sock comprises elastically pliable elements, such as elastic threads 63 that are woven in at the sewing portion, so as to create a surface adapted to take a diverging configuration, thus capable of automatically opening the sock is aperture for its gripping and its transfer into the sewing machine.

Thanks to the fact that the apparatus and the method that allow automatically feeding a sewing machine with a sock tip are autonomous and independent from the structure of the circular machine, besides preventing the jamming of the latter, they allow the transfer of more socks with a predetermined orientation from more circular machines on which they are manufactured, to a single sewing machine for sewing the tip, thus allowing the continuous use of this last-mentioned machine.

The invention achieves the proposed objects and also achieves several important advantages.

In fact, a new method and a new apparatus have been devised for automating the transfer of a sock manufactured on a circular machine for socks according to a predetermined orientation in the circular machine. Such solution will allow the transfer with predetermined orientation to the sewing machine so that it may sew two rims according to the required orientation.

The invention thus conceived can be subject to several modifications and variants, all falling within the scope of the present inventive idea; moreover, all details can be replaced with technically equivalent elements. The materials used, shapes and sizes can be of any type according to the requirements.

What is claimed is:

1. In combination with a sock-making machine having a rotating, needle cylinder and with a sewing machine, an apparatus comprising:

gripping means engageable in a pickup position in the needle cylinder to form therewith an annular gap in which a sock being made on the machine is formed and provided with grippers engageable with the sock;

rotation means for rotating the gripping means synchronously with the needle cylinder;

means for engaging the grippers with the sock in the gap; and transfer means for displacing the gripping means from the pickup position to a transfer position with the sock at the sewing machine.

2. The apparatus defined in claim 1 wherein the transfer means includes an arm displaceable along and pivotal about an axis parallel to the needle cylinder.

3. The apparatus defined in claim 2 wherein the gripping means includes a support base carried on the arm, tubular member extending parallel to the axis from the support and having an end carrying the grippers.

4. The apparatus defined in claim 3 wherein the tubular member is rotatable on the base, the rotation means including means for coupling the member to the needle cylinder for joint rotation.

5. The apparatus defined in claim 4, further comprising brake means for arresting rotation of the tubular member when not rotating with the needle cylinder.

6. The apparatus defined in claim 4, further comprising means for sucking in air at the base only when the member is rotating with the needle cylinder.

7. The apparatus defined in claim 3 wherein the grippers are pivotal on the member end and have points engageable with the sock in the needle cylinder.

8. The apparatus defined in claim 7 wherein the tubular member is provided with a drive member engageable with the grippers for pivoting and thereby spreading the points.

9. The apparatus defined in claim 7 wherein each gripper, includes a pinching head engageable with the respective point for gripping the sock.

10. The apparatus defined in claim 7 wherein the grippers are elastically deformable.

11. The apparatus defined in claim 10 wherein the grippers are made of music wire and are generally L-shaped.

12. The apparatus defined in claim 7 wherein the tubular-member end carries a central head having an outer surface, the grippers being engageable inward against the head to pinch the sock against the surface thereof.

13. The apparatus defined in claim 12 wherein the head has a thickened edge engageable with the grippers.

14. A method of displacing a sock from a sock-making machine having a rotating needle cylinder to a sewing machine, the method comprising the steps of sequentially:

engaging in the cylinder a gripper head to form with the cylinder an annular gap in which a sock being made on the machine is formed;

drawing air out from between the head and cylinder to draw the sock down over the head;

synchronously rotating the gripper head with the needle cylinder;

engaging a plurality of grippers on the head with the sock;

on completion of knitting of the sock, retracting the head out of cylinder with the sock engaged on the grippers; and displacing the head and sock to the sewing machine.

15. The method defined in claim 14 further comprising the steps after retracting the head and before displacing the head and sock to the sewing machine of arresting rotation of the head and stopping drawing of air out from between the head and cylinder.

16. The method defined in claim 14 wherein the head and sock are displaced by being pivoted about an axis parallel to the needle cylinder and moved upward parallel to the axis.

17. The method defined in claim 14 wherein the grippers are displaced radially of an axis of the needle cylinder into at least two opposite regions of the sock to engage with the sock.

18. The method defined in claim 14, further comprising the step of knitting onto an end edge of the sock a thickened region adapted to define a mechanical abutment for aligning with guides of the sewing machine.

19. The method defined in claim 18 wherein the thickened region has elastically pliable elements adapted to spread the end edge.

20. The method defined in claim 14 wherein the gripper head is engageable with the needle cylinders of at least two separate sock-making machines.

* * * * *